US008127503B2

(12) United States Patent
Kaiser et al.

(10) Patent No.: US 8,127,503 B2
(45) Date of Patent: Mar. 6, 2012

(54) SYMMETRIC ROOF SPOILER

(75) Inventors: Bruce A. Kaiser, Clearwater, FL (US); James R. Oldham, Woodstock, VT (US); Anthony M. DeMore, Willoughby, OH (US); Jesse P. Carlson, Chagrin Falls, OH (US); Jennifer M. Morzano, Long Branch, NJ (US)

(73) Assignee: Windtripper Corporation, Clearwater, FL (US)

( * ) Notice: Subject to any disclaimer, the term of this patent is extended or adjusted under 35 U.S.C. 154(b) by 72 days.

(21) Appl. No.: 12/777,879

(22) Filed: May 11, 2010

(65) Prior Publication Data

US 2011/0000143 A1 Jan. 6, 2011

Related U.S. Application Data

(60) Provisional application No. 61/222,344, filed on Jul. 1, 2009.

(51) Int. Cl.
*E04D 13/00* (2006.01)
*E04D 13/15* (2006.01)

(52) U.S. Cl. ..... 52/84; 52/11; 52/94

(58) Field of Classification Search ..... 52/11, 84, 52/24, 94, 97, 29, 64, 69; 248/48.1; 244/199.4
See application file for complete search history.

(56) References Cited

U.S. PATENT DOCUMENTS

| | | | | |
|---|---|---|---|---|
| 1,595,716 | A * | 8/1926 | Ford | 248/48.1 |
| 2,206,040 | A | 7/1940 | Ludington | |
| 2,270,537 | A | 1/1942 | Ludington | |
| 2,270,538 | A | 1/1942 | Ludington | |
| 4,579,303 | A * | 4/1986 | Midlik | 248/48.2 |
| 4,709,518 | A * | 12/1987 | Lane | 52/94 |
| 5,619,827 | A * | 4/1997 | Church | 52/60 |
| 6,168,125 | B1 * | 1/2001 | Winger et al. | 248/228.3 |
| 6,240,679 | B1 * | 6/2001 | Smalara | 52/16 |
| 6,314,685 | B1 * | 11/2001 | Sullivan | 52/12 |
| 6,601,348 | B2 | 8/2003 | Banks et al. | |
| 7,891,141 | B2 * | 2/2011 | Kennedy | 52/11 |
| 7,946,081 | B1 * | 5/2011 | Frederick | 52/11 |
| 2006/0248810 | A1 | 11/2006 | Ewing | |
| 2007/0113489 | A1 | 5/2007 | Kaiser | |

* cited by examiner

*Primary Examiner* — Robert Canfield
*Assistant Examiner* — Brent W Herring
(74) *Attorney, Agent, or Firm* — Gray Robinson, P.A.

(57) ABSTRACT

Disclosed is a roof spoiler that effectively disrupts the attached flow of wind on a roof surface. Preferably, the spoiler is specially designed for installation with a gutter mounted on the roof fascia or along the leading edge of the roof. This spoiler utilizes a hinged design to move between two operating positions. The first position is a stowed position, whereby the spoiler extends beyond the gutter and is designed to be nearly invisible to passersby. In the stowed position, a portion of the spoiler covers the outer edge of the gutter (if present). A second portion of the spoiler may extend outward from the gutter. The second position is a deployed position, wherein a barrier is projected vertically, or substantially vertically, so as to disrupt the flow of air over the roof surface. In one embodiment, the spoiler rests upon the roof covering when in the deployed position. In another embodiment, the spoiler rests near or against the gutter or holding bracket. In one embodiment, a bracketing system, or support structure, is placed around an existing gutter. The roof spoiler is then pivotally attached to this support structure. In another embodiment, the support structure attaches directly to the gutter.

20 Claims, 13 Drawing Sheets

SYMMETRIC ROOF SPOILER

CROSS-REFERENCE TO RELATED APPLICATIONS

This is a continuation of Provisional Patent Application Ser. No. 61/222,344, filed Jul. 1, 2009, entitled "Symmetric Roof Spoiler" the disclosure of which is hereby incorporated by reference herein.

FIELD OF THE INVENTION

The present invention relates to roofing systems. More particularly, it relates to an apparatus and a method for reducing wind damage to a roof.

BACKGROUND OF THE INVENTION

One of the worst types of structural damage that can befall a building is roof damage. The devastation caused by high winds, hurricanes, tornadoes and the like is depicted by the media, often by focusing on the damage done to homes, especially to the roofs of those homes. In these cases, damage to the roof often leads to tremendous damage to the rest of the building, as a result of structural damage, and damage caused by the elements, such as rain or snow.

The roof of a building serves a number of purposes. First, it protects the interior of the building from the elements, such as rain, snow and hail. It also serves as an important structural component of the building, often linking the walls together, and adding strength to the building.

Wind causes several different types of damage to a roof. First, the wind, when blowing in a certain direction, can flow between the roof covering and the underlying substrate. This air flow can cause the roof covering to peel up and lift itself off the roof. The removal of the roof covering leaves the exposed roof susceptible to water, which can now enter through the area that is no longer protected by the missing covering. A second type of damage is caused by the effect of high speed attached flow over the surface of the roof. The deflection of the flow over the roof line squeezes the streamlines closer together, accelerating the speed and lowering the static pressure in accordance with Bernoulli's principle. This causes uplift on part or all of the roof structure, thereby exerting an upward force on the roof. This force not only causes the roof covering to lift from the roof, but can also cause the roof to pull away from the joists to which it is attached.

Various attempts have been made to reduce the destructive effect of hurricane force winds on a roof, including various types of roof spoilers or wind deflectors. For example, various types of roof wind spoilers have been disclosed, for example, in U.S. Pat. No. 2,206,040, U.S. Pat. No. 2,270,537, U.S. Pat. No. 2,270,538, U.S. Pat. No. 6,601,348, and U.S. Patent Application Publication 2006/0248810. Most of these spoilers are attached directly onto the roof surface. To achieve their goal, most employ a member that, when deployed, is orthogonally disposed to the roof surface. This member may be either permanently disposed, or manually or automatically disposed only when needed. Other publications, for example U.S. Pat. No. 6,601,348, and U.S. Patent Application Publication 2007/0113489, disclose a spoiler that can be attached to the fascia, rather than the roof surface. As the air flow travels along the surface of the roof, this vertical barrier presents an obstacle to its continued flow. As a result, the wind must travel over the barrier, which causes the air flow to become turbulent. In fact, the air flow directly at the roof may reverse directions, thereby pushing the roof covering down. The turbulent nature of the air flow created by these spoilers significantly decreases the negative pressure area described above. FIG. 1*a* shows the flow of air over a typical roof. Note the attached flow as the wind moves over the roof surface. FIG. 1*b* shows the resulting air flow when a roof spoiler is installed on the roof. Note the turbulence created downwind of the spoiler. Also of interest is the change in the direction of the wind along the roof surface.

Up to now, no roof spoilers have enjoyed commercial success or gained widespread use. This lack of success is probably due to a number of reasons, including unattractive appearance (e.g., due to poor aesthetic design or location on roof surface), poor performance (e.g., due to product design, operation or location), costs, complexity of installation, etc.

Therefore, it is an object of the present invention to provide a roof spoiler device that creates a turbulent air flow on the roof surface to prevent wind damage. It is an additional object to provide a device that reduces the flow of air under the roof covering. It is a further object to provide a roof spoiler device that has an acceptable aesthetic appearance. It is also an object to provide a roof spoiler device that may be used in conjunction with a roof gutter.

SUMMARY OF THE INVENTION

The present invention embraces a roof spoiler that effectively disrupts the attached flow of wind on a roof surface. Preferably, the spoiler is specially designed for installation with a gutter mounted on the roof fascia or along the leading edge of the roof. This spoiler utilizes a hinged design to move between two operating positions. The first position is a stowed position, whereby the spoiler extends beyond the gutter and is designed to be nearly invisible to passersby. In the stowed position, a portion of the spoiler covers the outer edge of the gutter (if present). A second portion of the spoiler may extend outward from the gutter.

The second position is a deployed position, wherein a barrier is projected vertically, or substantially vertically, so as to disrupt the flow of air over the roof surface. In one embodiment, the spoiler rests upon the roof covering when in the deployed position. In another embodiment, the spoiler rests near or against the gutter or holding bracket.

In one embodiment, a bracketing system, or support structure, is placed around an existing gutter. The roof spoiler is then pivotally attached to this support structure. In another embodiment, the support structure attaches directly to the gutter.

DETAILED DESCRIPTION OF THE INVENTION

Figure 1A:
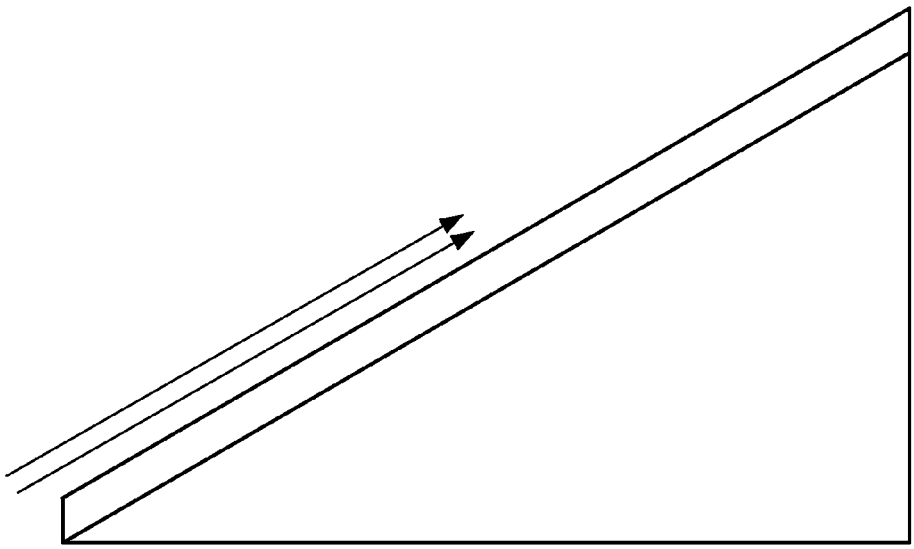
FIG. 1 depicts airflow over a roof surface with and without a roof spoiler.
Figure 1B:
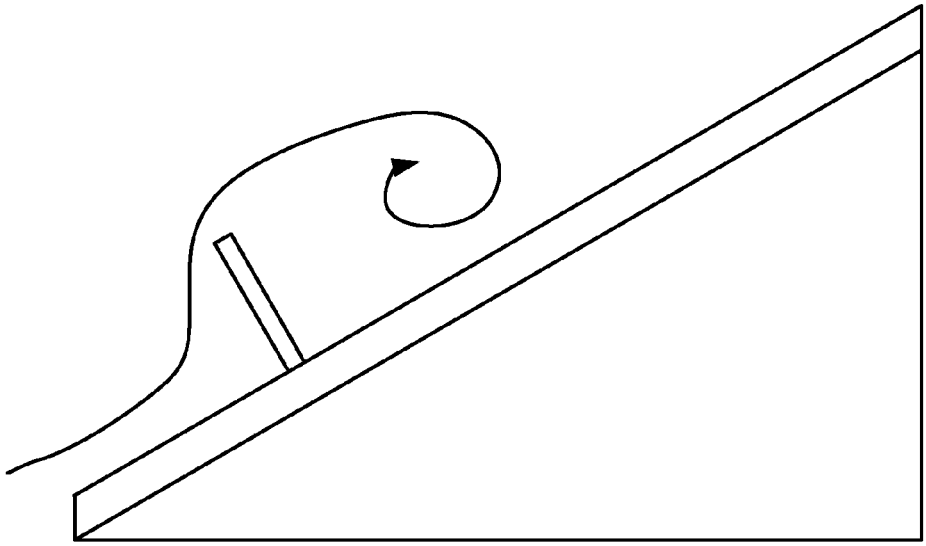

A roof spoiler is intended to present an obstacle to attached flow during high (e.g., hurricane-force) winds. One way to present such an obstacle is to introduce a vertical, or substantially vertical member that interrupts that air flow. In other embodiments, the obstacle may not be vertical, but rather orthogonal to the roof surface, as shown in FIG. 1*b*. However, as mentioned above, a vertical member attached to the roof surface is unsightly and not likely to be adopted.

To improve the aesthetics of a roof spoiler, it is preferable that the spoiler has at least two operating positions; a deployed position, where it acts as an obstruction as described above, and a stowed position, where the spoiler should be relatively non-intrusive and barely visible to passersby.

Figure 2:
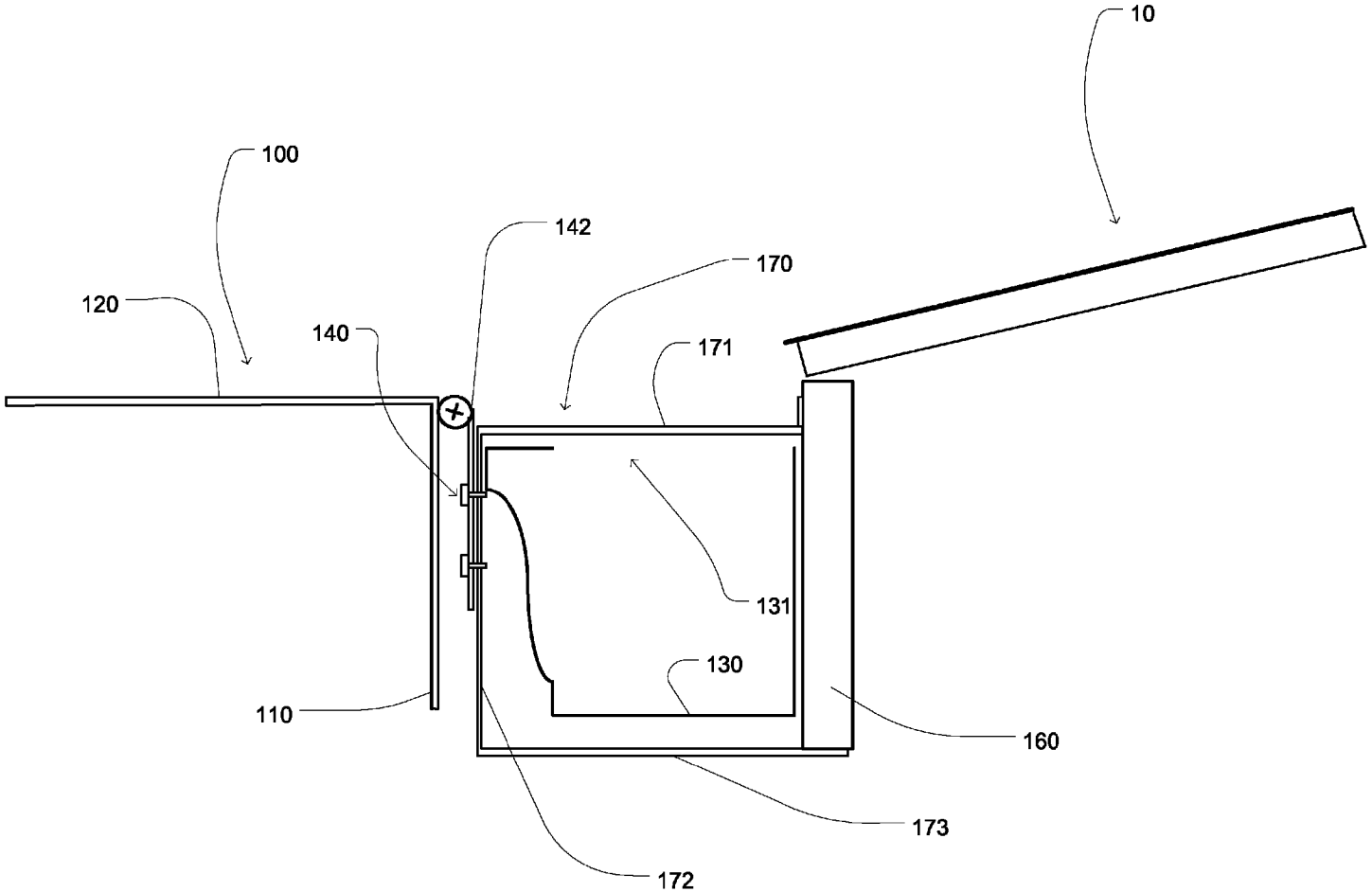
FIG. 2 depicts a cross-section of a first embodiment of a roof spoiler of the present invention, in the stowed position.

One embodiment of such a roof spoiler is depicted in FIG. 2, which shows a cross-section of a first embodiment of the roof spoiler in the stowed position. The roof spoiler 100 is preferably L-shaped, with two roughly orthogonal members; a first member 110 and a second member 120. Each member has a length (i.e., the short dimension that extends away from the roof edge) and a width (i.e., the long dimension parallel to the roof edge) and preferably is substantially planar. In the stowed position, the first member 110 is disposed in an approximately vertical orientation, extending downwardly on the outside of the gutter 130 (if a gutter is desired and present). In some embodiments, the first member may be disposed orthogonal (i.e., at approximately a 90° angle) to the roof surface. This first member 110 can be any suitable length, such as 15 cm to 31 cm, preferably about 20 cm to 24 cm.

The second member 120 is disposed in an approximately horizontal orientation, extending away from the gutter 130. In some embodiments, such as the one shown in FIG. 2, the second member may be perpendicular to the first member. The second member 120 can be of any suitable length, such as 15 cm to 31 cm, preferably about 20 cm to 24 cm. Preferably, the length of the second member 120 is greater than the distance from the pivot connection 142 to the roof edge. This allows the second member 120 to rest upon the roof 10 in the deployed position.

Figure 3:
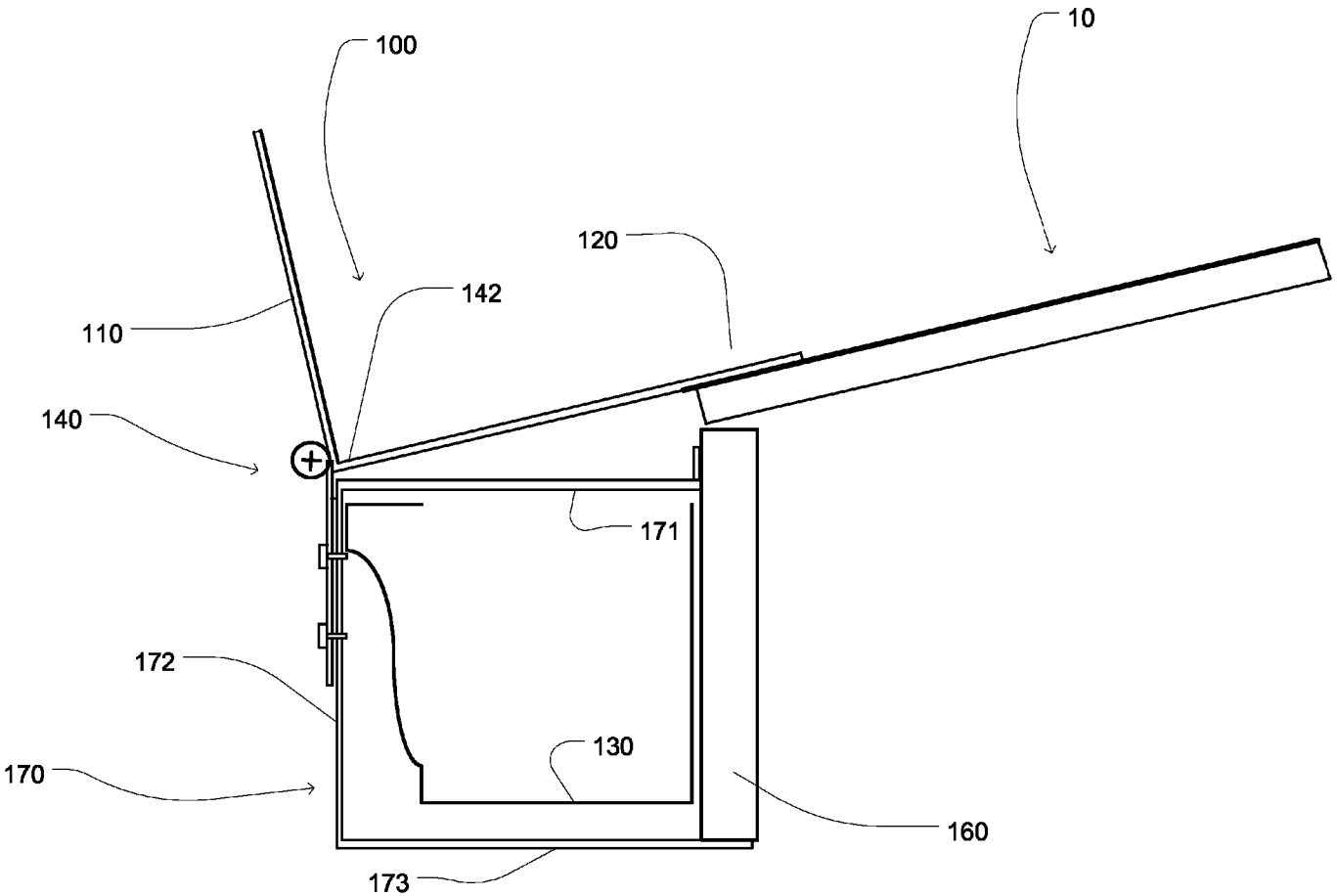
FIG. 3 depicts the roof spoiler of FIG. 2 in the deployed position.

FIG. 3 shows the spoiler of FIG. 2 in the deployed position. As stated above, in one embodiment, the second member 120 is sufficiently long so that it extends to and rests upon the roof 10 in this position. In another embodiment, the second member 120 rests on the support structure 170 in the deployed position. Although the first member 110 and the second member 120 are shown as being orthogonal, the invention is not so limited. The angle formed between the two members can vary. For example, in one embodiment, the angle is less than 90 degrees, such that the first member 110 is vertical.

The members 110, 120 are constructed from a durable material, such as metal, alloys, composites, plastics (such as PVC and ABS), polymers, polymer composites, and building materials, such as wood or wood composites, cement, or cemtitious boards. Factors such as strength, durability, ultraviolet and corrosion resistance, manufacturability and cost may be used to select an appropriate material. In some embodiments, the two members are formed as a unitary piece, which is preferably extruded to reduce cost. In some embodiments, the two members are the same thickness, while in other embodiments, the thicknesses of the two members differ. The thickness of each member is determined based on the material used and the desired durability and rigidity of that member.

The roof spoiler 100 is in communication with a pivoting mechanism 140, such as a hinge. The roof spoiler 100 is configured to operate with the pivoting mechanism 140 such that it rotates from about 150° to about 180°, from its stowed position to its deployed position. In some embodiments, the pivoting mechanism 140 is a simple hinge, such as shown in FIG. 2.

Figures 4A, 4B:
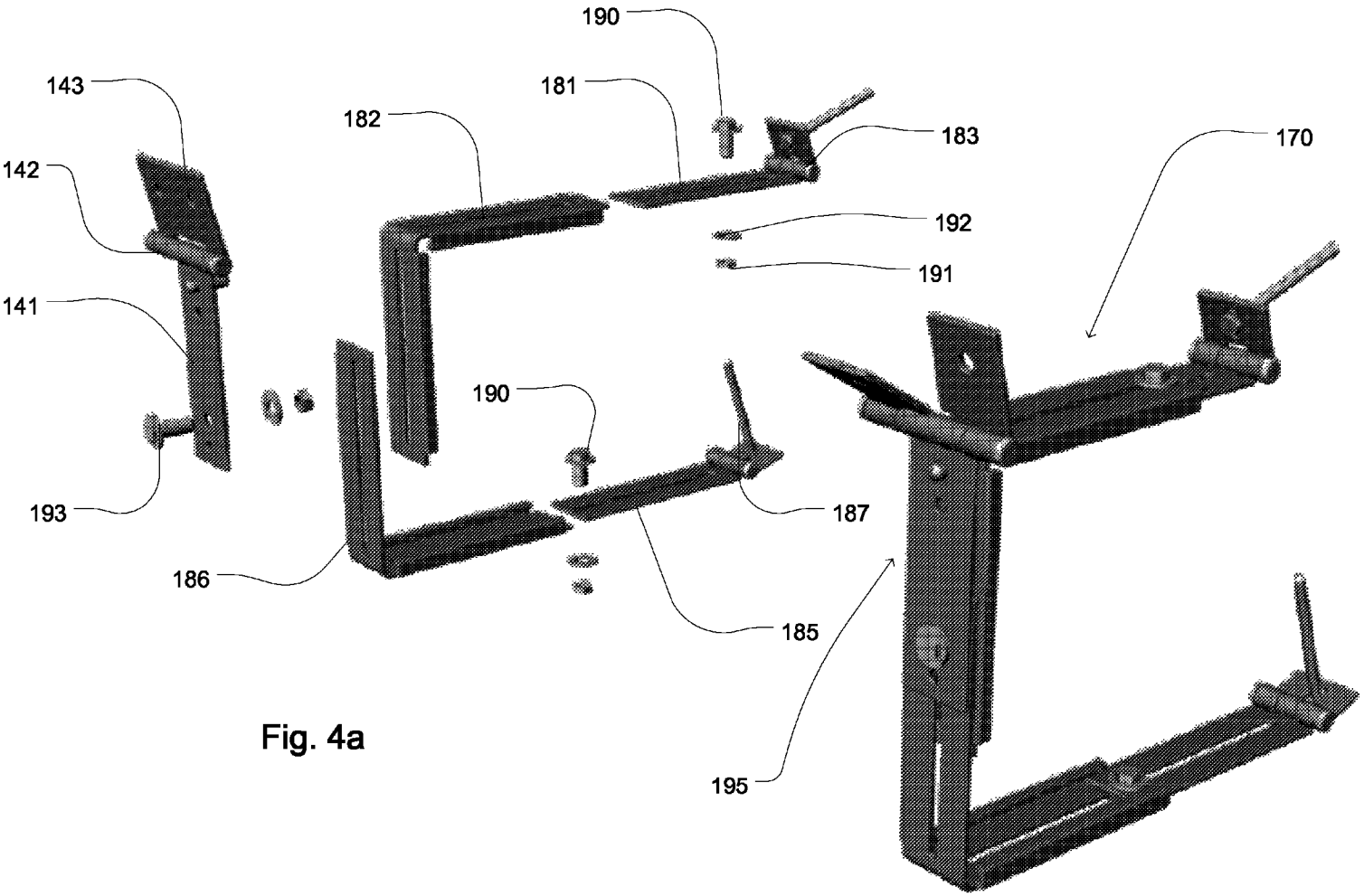
FIG. 4*a* depicts an exploded view of one embodiment of the support structure used in the present invention.
FIG. 4*b* depicts an assembled view of the embodiment of FIG. 4*a;*

In this embodiment, the roof spoiler is positioned beyond the gutter 130 by means of one or more brackets. In FIG. 2, the support structure 170 is comprised of a top horizontal bracket 171, a bottom horizontal bracket 173, and a vertical bracket 172. These brackets form a frame that surrounds the gutter 130, thereby supporting the roof spoiler 100 without requiring any mechanical support from the gutter 130. In some embodiments, brackets 171, 172, 173 form a unitary piece, designed to be affixed to the fascia. In other embodiments, the brackets are individual pieces, which can be pre-assembled, or assembled on site to match the size of the gutter that it is intended to surround. These pieces may be made of any suitable material including metals, such as aluminum or steel. FIGS. 4*a*-*b* show one embodiment where a number of separate components are used to create the support structure 170.

FIG. 4*a* shows an exploded view of one embodiment of the support structure 170. FIG. 4*b* shows an assembled version of this embodiment. In this embodiment, the top horizontal bracket is made up of a top mounted bracket 181 and a top corner bracket 182. Both brackets 181, 182 have a slot, such that a fastener 190, such as a bolt, may be placed through the two slots. The fastener 190 may be mated with a corresponding nut 191 and an optional washer 192. The fastener 190 is tightened at the position where the overall length of brackets 181, 182, as assembled, is longer than the gutter that it seeks to surround. The bottom horizontal bracket is also made up of two components, bottom mounted bracket 185 and bottom corner bracket 186. As described above, a fastener 190 may be used to hold these two components together. In one embodiment, the lengths of the top and bottom assembled brackets is the same. The vertical bracket is comprised of top corner bracket 182 and bottom corner bracket 183. A third fastener 193 may be used to hold these two components together. Top mounted bracket 181 and bottom mounted bracket 186 are shown as each having a pivoting connection 183, 187, respectively. These pivoting connections allow the mounted brackets 181, 185 to be installed on the fascia 160, regardless of the angle of the fascia. In other words, the top mounted bracket 181 may be affixed to the fascia at a right angle, while the bottom mounted bracket 185 may be affixed to the fascia at a different angle. FIG. 2 shows the top mounted bracket 181 connected at a right angle, while the bottom mounted bracket 185 is connected in a straight line to the bottom of the fascia. In another embodiment, the bottom mounted bracket 185 may also be connected perpendicularly to the fascia, or at any other angle.

While FIG. 4 shows 4 bracket pieces with pivoting connections to the fascia, the disclosure is not limited to this embodiment. For example, the entire support structure 170 may be one unitary piece. In another embodiment, the corner brackets 182, 186 may be a unitary piece, which is made to surround most common sized gutters. In certain embodiments, cost can be reduced by having the top and bottom mounted brackets 181, 185 be the same component. Similarly, the top and bottom corner brackets 182, 186 may also be a common part, if desired. In this way, the assembly shown in FIG. 4*a* may be comprised of 2 mounted brackets with pivoting connections, two corner brackets, three bolts, three nuts and three washers.

In another embodiment, the mounted brackets 181, 185 may not have pivoting connections. Rather their connection points may be fixed at a predetermined angle, such as perpendicular or colinear.

In yet another embodiment, the support structure 170 may not comprise all three components (top bracket 171, bottom bracket 173, and vertical bracket 172). For example, the support structure may only have a top bracket, firmly affixed to the fascia, which is used to support the roof spoiler 100. Note that the use of a three-part support structure 170 (as shown in FIG. 2), or the 4-part structure (shown in FIG. 4) is not meant to limit the invention, rather it simply depicts several embodiments of the support structure 170.

Roof spoiler 100 is connected to support structure 170 via a pivoting mechanism 140. The pivoting mechanism may be a simple hinge, as shown in FIG. 4. In this figure, the hinge 195 includes a pivoting connection 142, a first portion 141 mounted to the support structure 170, and a second portion connected 143 to the roof spoiler 100. The first portion 141 is shown connected to the top and bottom corner brackets 182, 186 in this figure. A fastener is used to connect these three components together. However, other methods of affixing a pivoting connection 142 to the support structure 170 are also within the scope of the invention. The first portion 141 is pivotally attached to the second portion 143, which is attached to the roof spoiler 100.

Figure 5:
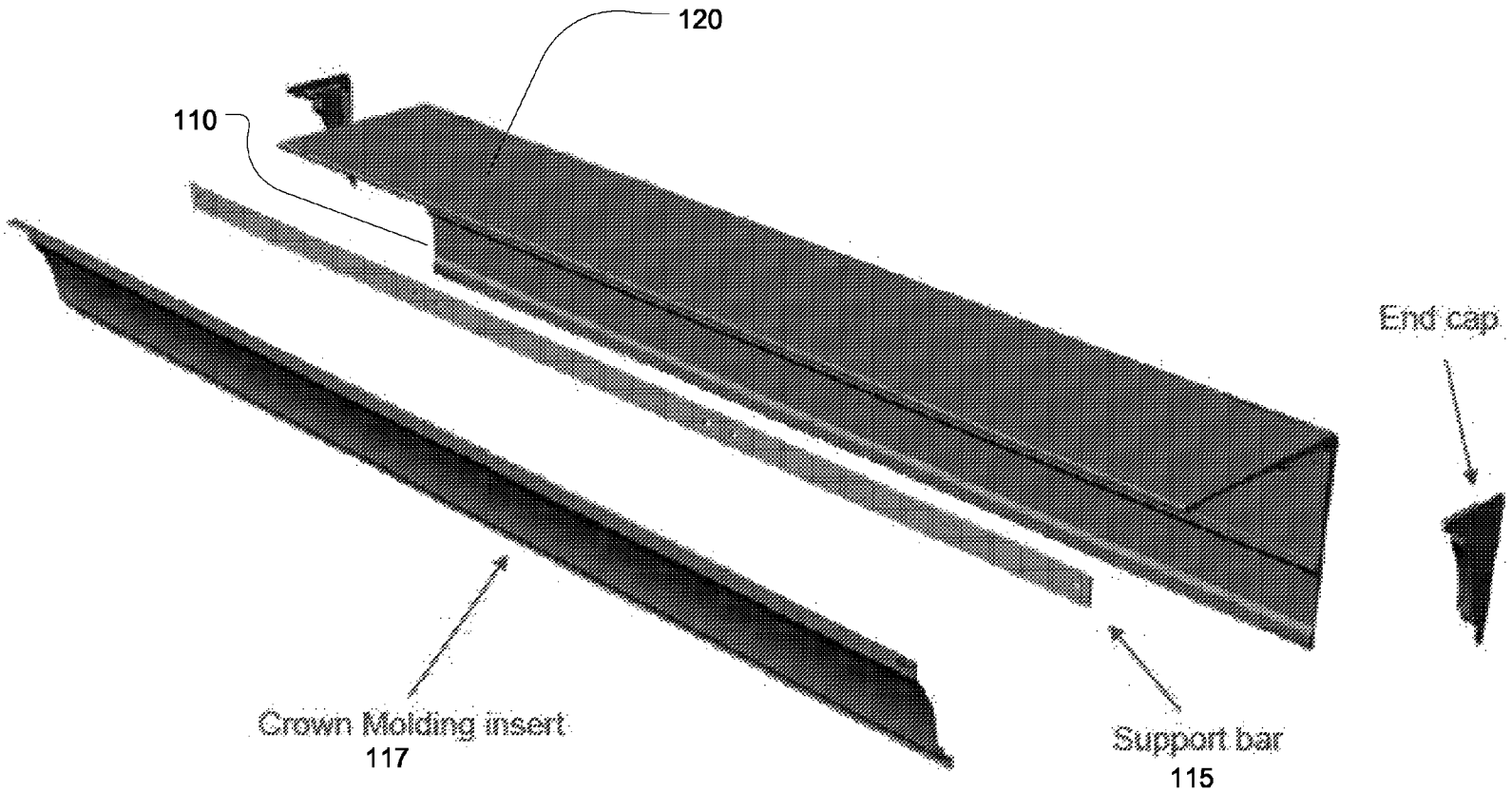
FIG. 5 depicts an exploded view of one embodiment of the roof spoiler used with the present invention.

FIG. 5 shows an exploded view of a roof spoiler 100 that can be used with the present invention. In this embodiment, first member 110 and second member 120 are extruded as a unitary piece. A support bar 115, preferably made of metal or another suitable material, is fastened to the second portion 143 of the hinge 195, thereby sandwiching the first member 110 between the second portion 143 and the support bar 115 and holding it in place. A fastener 194 may be used to connect the support bar 115, the first member 110 and the second portion 143 of the hinge 195. In other embodiments, the first member 110 is attached directly to the second portion 143. The actual attachment mechanism is purely illustrative and other methods of attaching the spoiler 100 to the pivoting connection 142 are understood by those of ordinary skill in the art and are within the scope of the invention.

Figure 6:
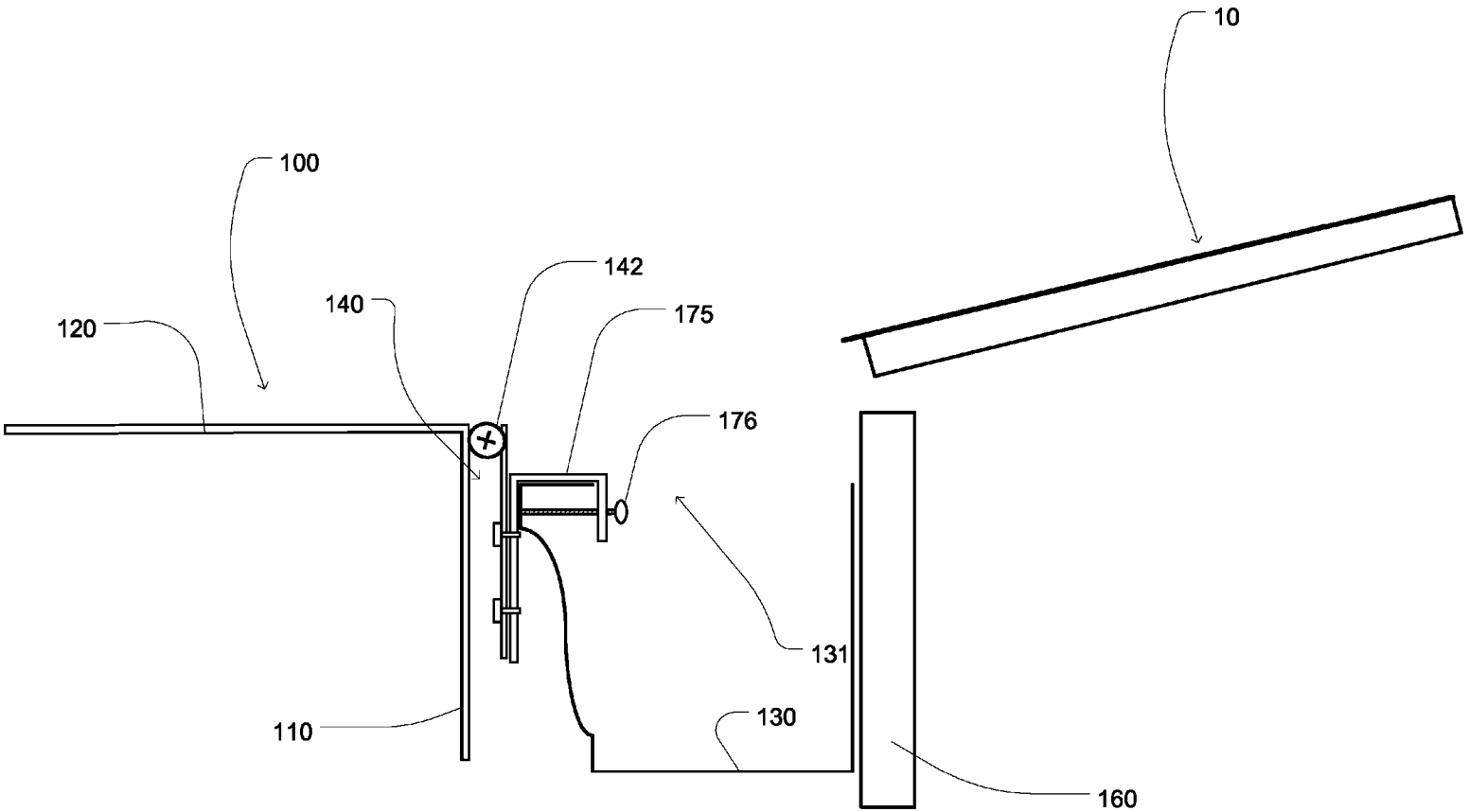
FIG. 6 depicts a cross-section of a second embodiment of a roof spoiler of the present invention, in the stowed position.

For example, in another embodiment, no support structure 170 is provided. Rather, the pivoting mechanism 140 is attached directly to the gutter 130. This attachment can be permanent, such as via a fastener. In other embodiments, the roof spoiler 100 may connect to the gutter via a clip-on attachment. Such an embodiment requires the gutter to support the weight of the spoiler 100, as well as the force exerted on it during a high speed wind storm. Such an embodiment is shown in FIG. 6. In this embodiment, a support structure 175 is placed over the lip of the gutter 130. As before, pivoting mechanism 140 is connected to the support structure 175. In another embodiment, a fastener, such as wingnut 176, is used to secure support structure 175 to the gutter 130. In this embodiment, the support structure 175 is slipped over the lip of the gutter 130. The wingnut 176 is then tightened so as to securely attach the support structure 175 to the gutter 130.

Returning to FIG. 5, the roof spoiler may optionally have a decorative insert 117 located in the angle formed between the first member 110 and the second member 120. Since the roof spoiler is visible while in its stowed position, such a decorative insert improves the aesthetic value of the spoiler. Such an insert also serves to conceal the support bar 115, or any fasteners used to attach the spoiler 100 to the pivoting mechanism 140. In some embodiments, endcaps 119 may be placed on the ends of the roof spoilers. These endcaps 119 may serve two purposes. Like the insert 117, these components have an aesthetic value. They also have structural value in that they may hold the first member 110 and second member 120 at their intended angle, in the presence of high speed wind.

Figure 7:
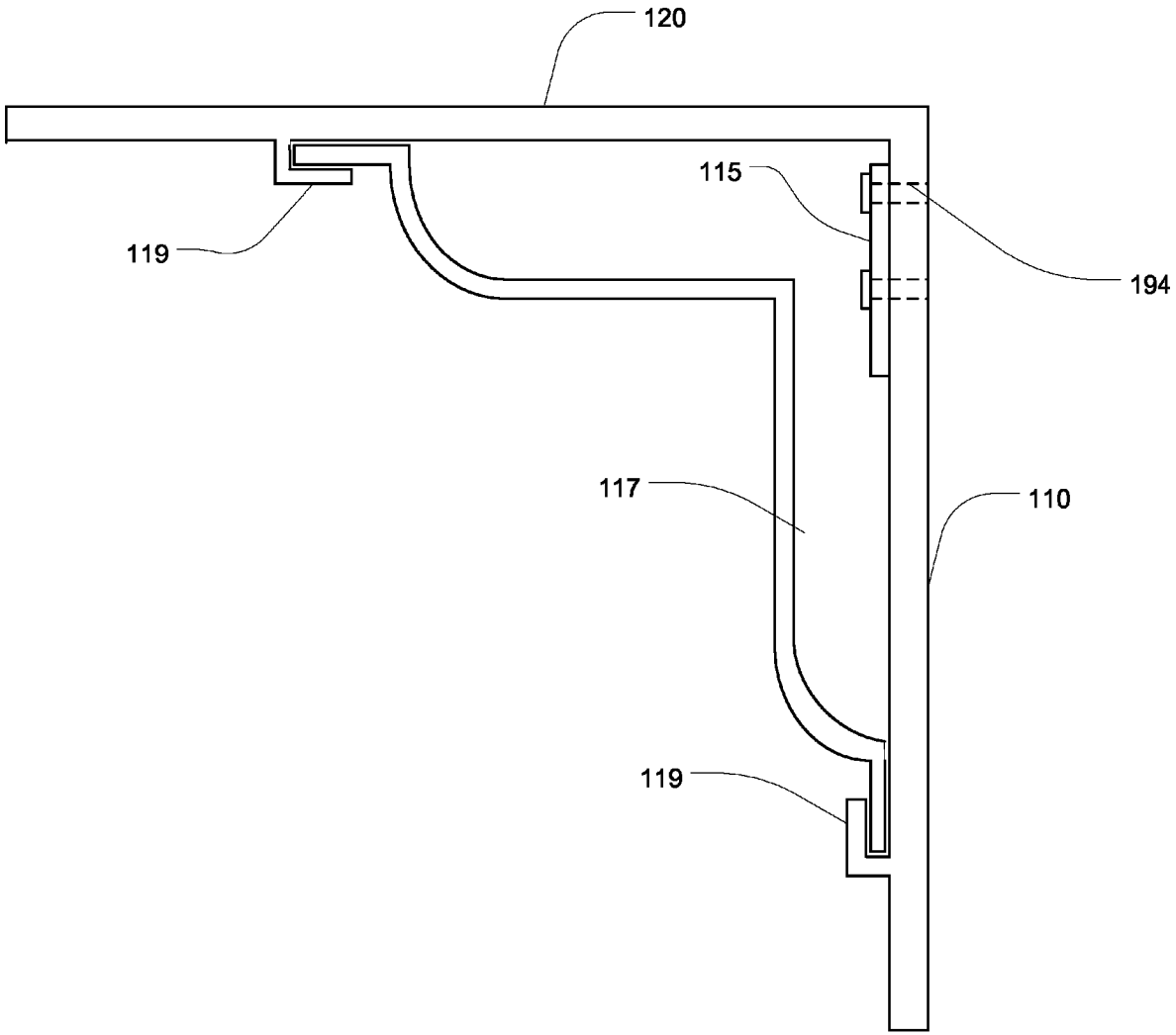
FIG. 7 depicts the roof spoiler of FIG. 6 in the deployed position.

FIG. 7 shows a side view of the roof spoiler of FIG. 5. In this embodiment, the support bar 115 is positioned against to the first member 110, near the junction of the second member 120. Fasteners 194 may be used to secure the support bar 115, the first member 110 to the pivoting mechanism 140. Decorative insert 117 is shown to have multiple arcuate surfaces. These surfaces are purely illustrative and any surface or pattern of surfaces may be used. For example, the insert may be form so as to resemble a piece of crown molding if desired. In one embodiment, the first and second members are extruded and may have clips 119 extending from their inner surfaces. These clips 119 may be used as an inexpensive method of holding the insert 117 in place, as shown in FIG. 7. In this embodiment, the insert is form from a somewhat pliable material, such as a plastic. The insert 117 is then inserted into one of the two clips 119. The insert is then slightly squeezed or compressed so that its opposite edge can be inserted into the other dip.

Figure 8:
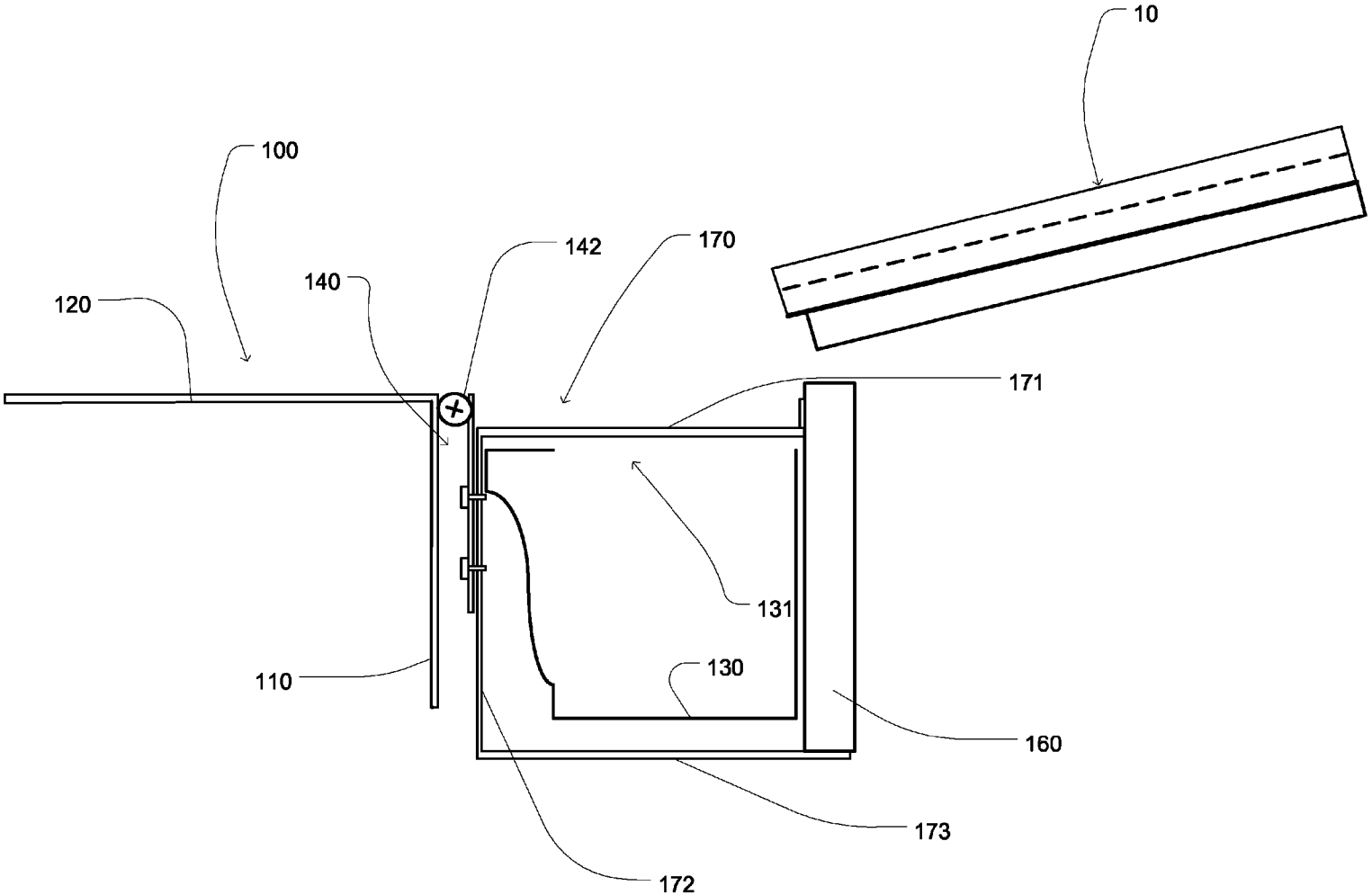
FIG. 8 depicts a cross-section of a first embodiment of a roof spoiler of the present invention used with a tile roof, in the stowed position.
Figure 9:
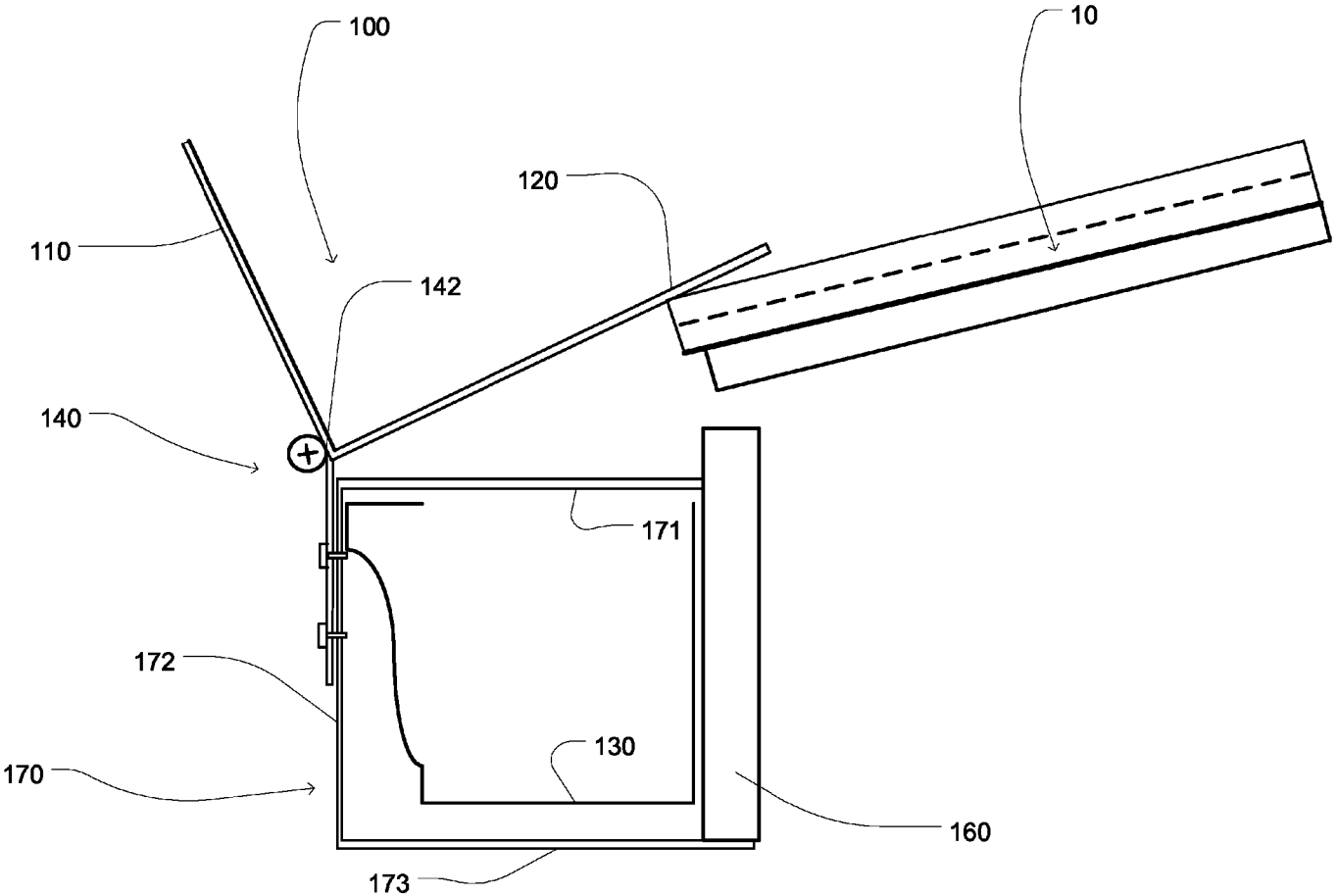
FIG. 9 depicts the roof spoiler of FIG. 4 in the deployed position.

In some embodiments, a thicker roof, such as a tile roof, may be used with the present invention. In such an embodiment, the roof spoiler may be attached in a number of ways. In one embodiment, shown in FIGS. 8 and 9, the same mechanism as was used in FIG. 2 is employed. In this embodiment, the angle of the first member 110 with respect to the roof deviates further from orthogonal than with a flat roof (as shown in FIG. 3).

Figure 10:
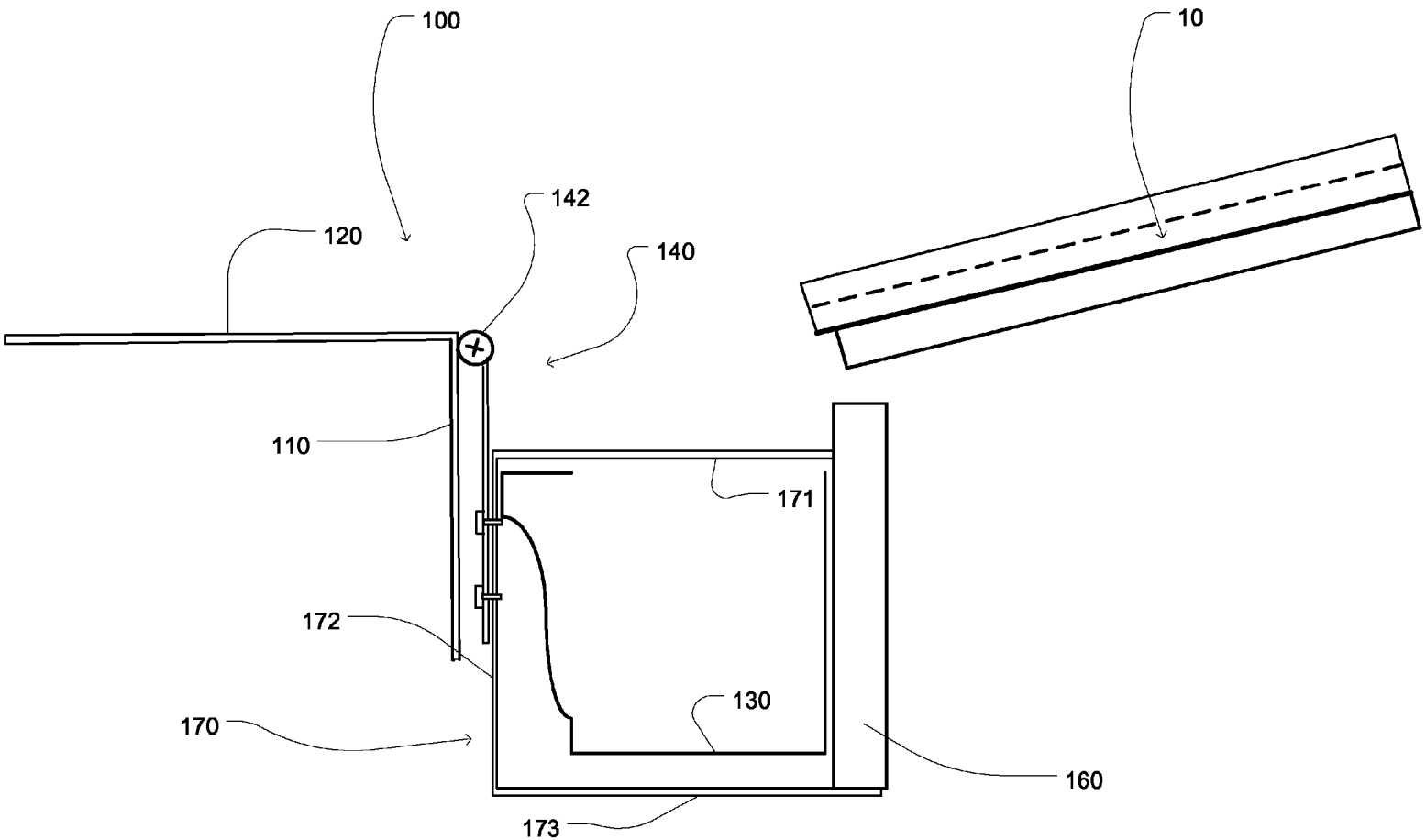
FIG. 10 depicts a cross-section of a second embodiment of a roof spoiler of the present invention, in the stowed position.
Figure 11:
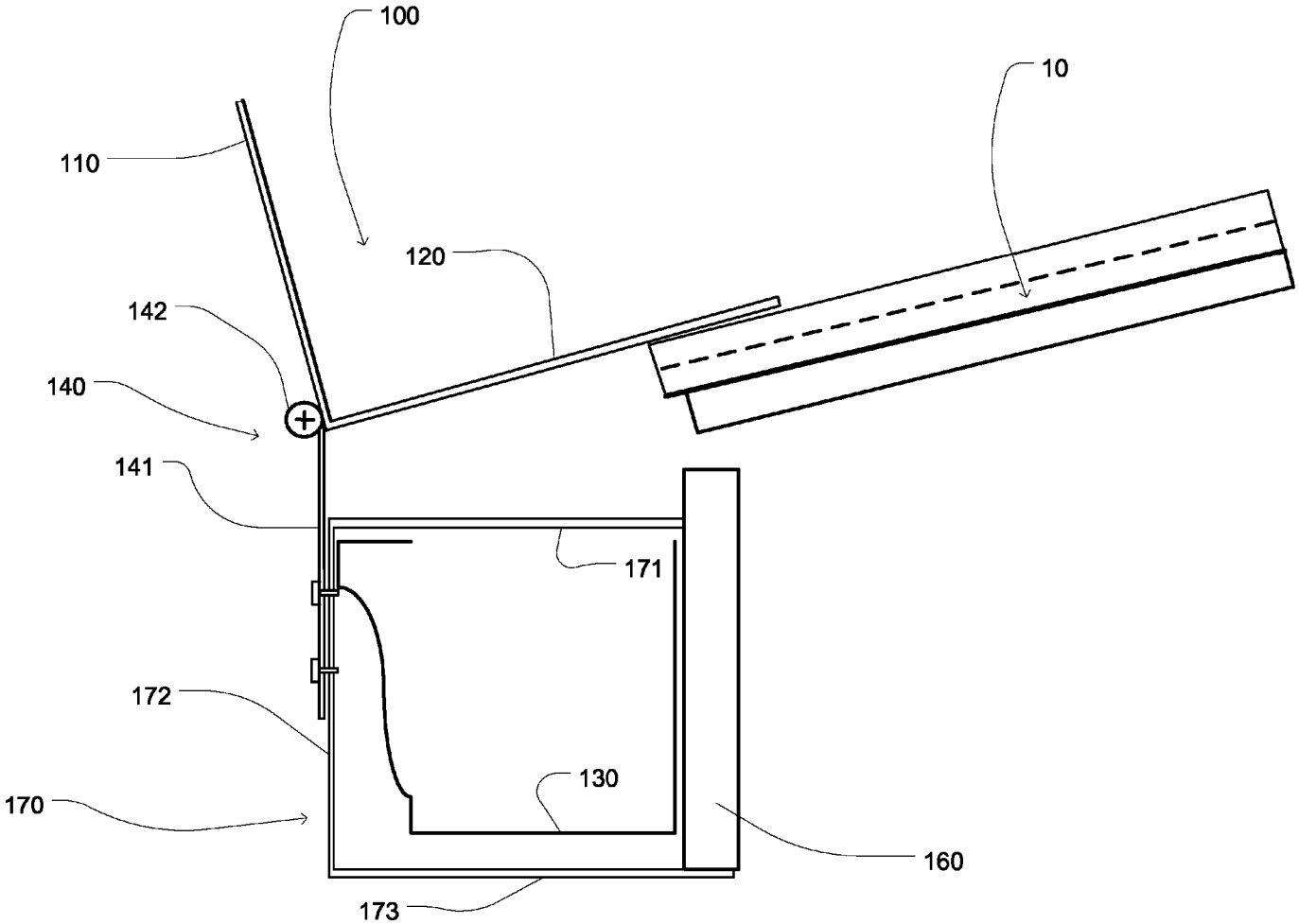
FIG. 11 depicts the roof spoiler of FIG. 10 in the deployed position.

In another embodiment, the pivoting connection 142 is adjusted vertically such that the second member 120 lays flat on the roof, and the first member 110 extends orthogonally from the plane of the roof. This embodiment is shown in FIG. 10 and FIG. 11. In this embodiment, since the pivoting connection 142 is positioned to be planar with the roof surface, the second member 120 lies flat on the roof. This allows first member 110 to extend orthogonally from the place of the roof.

One potential issue associated with the embodiment of FIG. 11 is the possibility that wind will blow in the gap defined between the gutter 130 and the roof spoiler 100, while it is in the deployed position. This wind can then be tunneled beneath the tile roof, thereby separating it from the surface of the building. In one embodiment, this gap is closed by utilizing a solid first portion 141 of pivoting mechanism 140. This first portion would block the gap from the gutter 130 to the pivoting connection 142, thereby keeping wind out.

Figure 12:
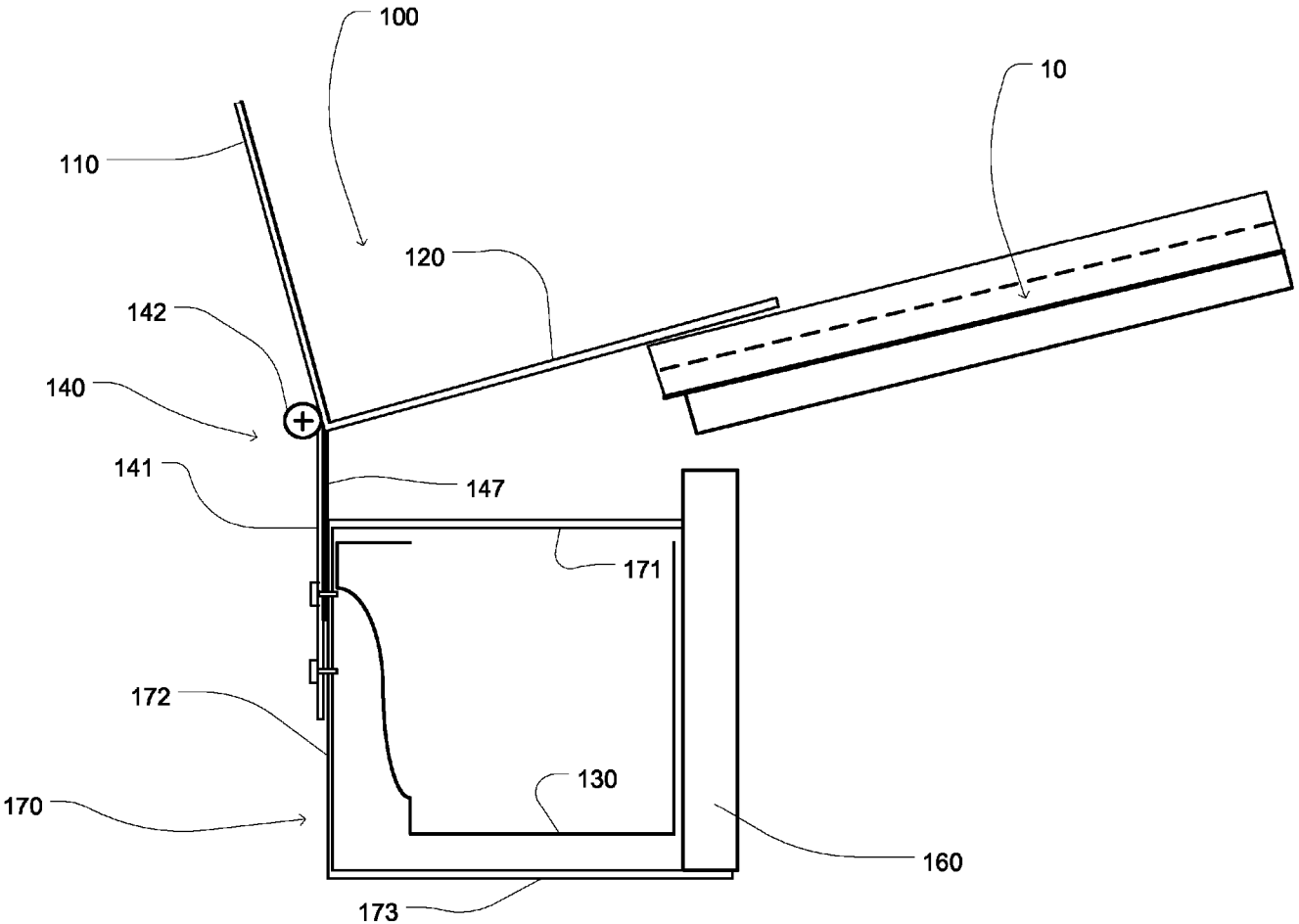
FIG. 12 depicts a cross-section of the roof spoiler of FIG. 11 with a wind guard.

In another embodiment, a thinner first portion 141, such as that shown in FIG. 4*a* is used. In this embodiment, a wind guard is inserted in the gap between the gutter and the pivoting connection. For example, referring to FIG. 4*a*, a wind guard may be installed between the first portion 141 and the top and bottom corner brackets 182, 186. This wind guard may be a solid coplanar piece, made of material such as that used for the first and second members. In another embodiment, the wind guard is rotatably attached to the pivoting connection 142. In this way, it can move freely with the deployment of the spoiler such that no gap is present between the spoiler and the roofing material. FIG. 12 shows wind guard 147 in its installed position, while the spoiler 100 is in the deployed position.

Figure 13:
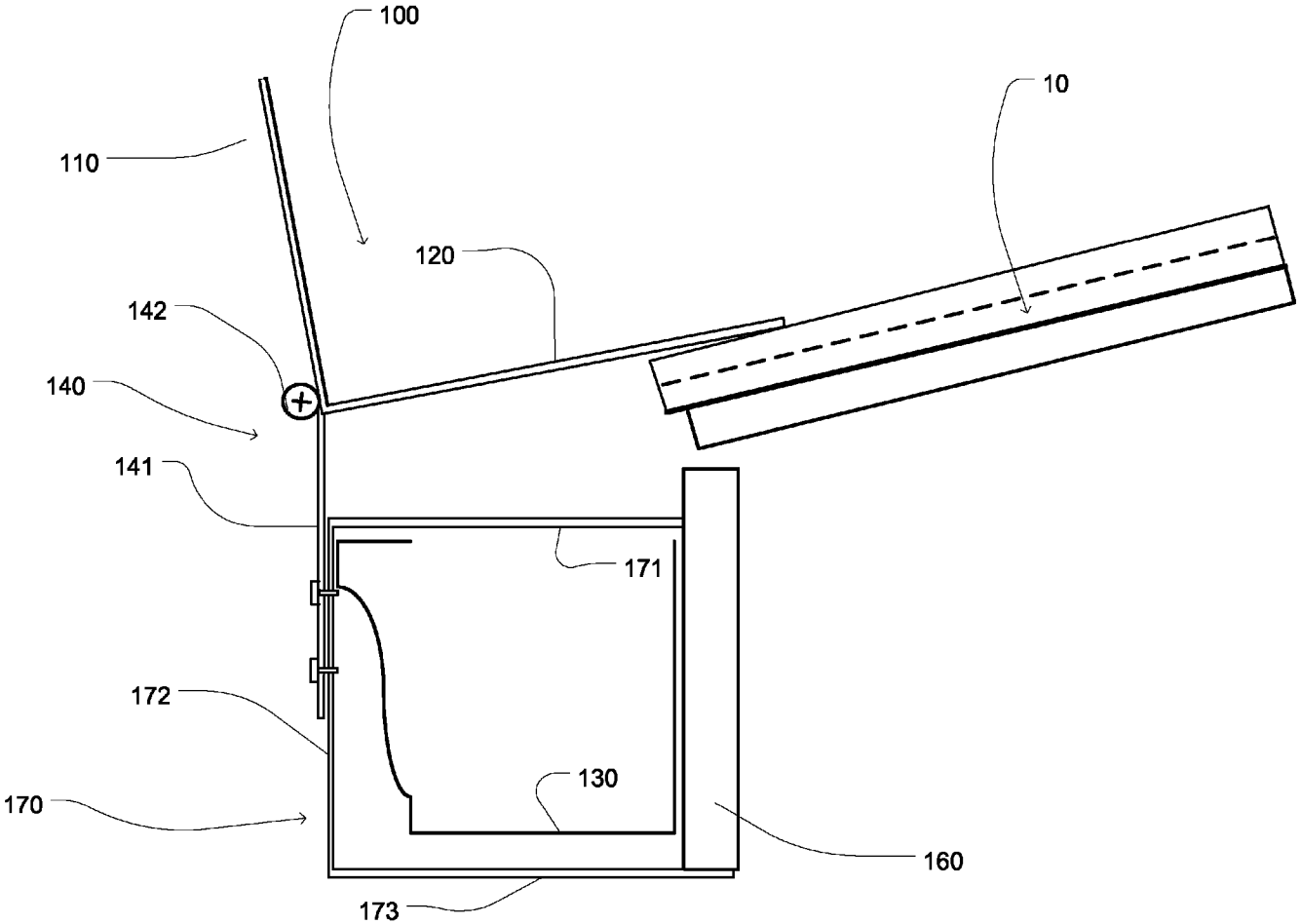
FIG. 13 depicts the roof spoiler of FIG. 12 where the first member moves past orthogonal to the roof surface.

The roof spoiler in these embodiments is intended to pivot from a stowed position, where the first member 110 is substantially vertical and the second member is substantially horizontal, to a deployed position where the second member 120 is preferably coplanar with the roof surface and the first member 110 extends orthogonally upward from the plane of the roof surface. In other words, in one embodiment, the first member moves from extending vertically downward to extending upward after going through a rotation of 180-θ°, where θ is the pitch of the roof. In another embodiment, the spoiler rotates less than 180-θ°, where θ is the pitch of the roof, such as the embodiment of FIG. 9. In another embodiment, the spoiler rotates slightly more than 180-θ°, such as is shown in FIG. 13.

The invention claimed is:

1. A device to redirect the flow of air over a roof, comprising:

a wind spoiler having a first member and a second member, said first member having a first length and a first width and said second member having a second length and a second width, wherein said first width is approximately coextensive with said second width, said first member being affixed to said second member along their respective widths such that said second member extends from said first member at an angle of about 60° to 120°;

and a support structure adapted to attach to the fascia of said roof; said wind spoiler first member being pivotally connected to said support structure, such that said wind spoiler may rotate from a stowed position to a deployed position; said support structure comprising a top mounted bracket adapted to attach to said fascia, a bottom mounted bracket adapted to attach to said fascia, a top corner bracket, slidingly attached to said top mounted bracket and a bottom corner bracket slidingly attached to said top corner bracket and said bottom mounted bracket.

2. The device of claim 1, wherein said top mounted bracket has a pivoting end, said pivoting end adapted to attach to said fascia.

3. The device of claim 1, wherein said bottom mounted bracket has a pivoting end, said pivoting end adapted to attach to said fascia.

4. The device of claim 1, wherein said top mounted bracket has a open slot and said top corner bracket has an open slot and said top mounted bracket and said top corner bracket are slidingly attached via a fastener located in said slots.

5. The device of claim 1, wherein said bottom mounted bracket has a open slot and said bottom corner bracket has an open slot and said bottom mounted bracket and said bottom corner bracket are slidingly attached via a fastener located in said slots.

6. The device of claim 1, wherein said top corner bracket has a open slot and said bottom corner bracket has an open slot and said top corner bracket and said bottom corner bracket are slidingly attached via a fastener located in said slots.

7. The device of claim 1, further comprising a pivoting mechanism, having a first portion attached to said support structure, a second portion attached to said roof spoiler first member and a pivoting connection connecting said first and second portions.

8. The device of claim 7, wherein said pivoting mechanism is attached to said support structure such that said pivoting connection is coplanar with the surface of said roof.

9. The device of claim 7, wherein said first portion of said pivoting mechanism is attached to said top corner bracket.

10. The device of claim 9, further comprising a wind guard positioned between said first portion of said pivoting mechanism and said top corner bracket.

11. The device of claim 7, further comprising a support bar positioned against said first member, such that said first member is sandwiched between said support bar and said second portion of said pivoting mechanism.

12. The device of claim 11, further comprising a cover connected to said first member and said second member, so as to conceal said support bar.

13. The device of claim 1, wherein said top mounted bracket is affixed to said fascia above a gutter, and said bottom mounted bracket is affixed to said fascia below said gutter.

14. The device of claim 1, wherein said wind spoiler rotates from said stowed position, wherein said first member extends vertically downward to a deployed position via a rotation of between 150 and 180 degrees.

15. The device of claim 1, wherein said first member is pivotally connected to said support structure via a hinge.

16. The device of claim 1, further comprising a cover connected to said first member and said second member.

17. The device of claim 1, wherein said second member is dimensioned so that a portion of said second member contacts said roof when said wind spoiler is in said deployed position.

18. The device of claim 1, wherein said first member and said second member are orthogonal to one another.

19. A combination to redirect the flow of air over a roof, comprising:

a roof;

a fascia located at the edge of said roof;

a wind spoiler device attached to said fascia, said wind spoiler device comprising a wind spoiler having a first member and a second member, said first member having a first length and a first width and said second member having a second length and a second width, wherein said first width is approximately coextensive with said second width, said first member being affixed to said second member along their respective widths such that said second member extends from said first member at an angle of about 60° to 120°;

and a support structure attached to the fascia of said roof; said wind spoiler first member being pivotally connected to said support structure, such that said wind spoiler may rotate from a stowed position to a deployed position; said support structure comprising a top mounted bracket attached to said fascia, a bottom mounted bracket attached to said fascia, a top corner bracket, slidingly attached to said top mounted bracket and a bottom corner bracket slidingly attached to said top corner bracket and said bottom mounted bracket.

20. The combination of claim 19, wherein said first member extends downwardly in said stowed position and extends upwardly orthogonal to said roof in said deployed position.

* * * * *